US007690227B2

(12) United States Patent
Cho et al.

(10) Patent No.: US 7,690,227 B2
(45) Date of Patent: Apr. 6, 2010

(54) DRUM TYPE WASHER

(75) Inventors: Han Ki Cho, Gimhae-si (KR); Jong Sun Yoon, Jinju-si (KR); Ho Sung Jang, Gyeongsangnam-do (KR); Chang Woo Son, Gimhae-si (KR); Jae Cheol Lyu, Changwon-si (KR)

(73) Assignee: LG Electronics Inc., Seoul (KR)

( * ) Notice: Subject to any disclaimer, the term of this patent is extended or adjusted under 35 U.S.C. 154(b) by 656 days.

(21) Appl. No.: 11/476,936

(22) Filed: Jun. 29, 2006

(65) Prior Publication Data

US 2007/0017259 A1 Jan. 25, 2007

(30) Foreign Application Priority Data

Jun. 30, 2005 (KR) ..... 10-2005-0057734
Jun. 30, 2005 (KR) ..... 10-2005-0057735

(51) Int. Cl.
*D06F 37/00* (2006.01)
*D06F 37/06* (2006.01)

(52) U.S. Cl. ..... 68/58; 68/142; 366/228

(58) Field of Classification Search ..... 68/24, 68/58, 142; 366/220, 228, 232, 234
See application file for complete search history.

(56) References Cited

U.S. PATENT DOCUMENTS

2003/0074932 A1* 4/2003 No et al. ..... 68/58
2005/0022565 A1* 2/2005 Jung et al. ..... 68/24

FOREIGN PATENT DOCUMENTS

EP 1 306 479 A2 5/2003

OTHER PUBLICATIONS

German Office Action dated Feb. 25, 2009.

* cited by examiner

*Primary Examiner*—Joseph L Perrin
(74) *Attorney, Agent, or Firm*—KED & Associates, LLP

(57) ABSTRACT

A drum type washer is provided in which replacement of a washing ball provided in a drum lift device may be simplified, and in which a volume of the drum may be increased. The washer may include a tub, a drum rotatably provided within the tub, and a lift provided within the drum. The lift may include a base detachably coupled to an inner surface of the drum and a cover detachably coupled to the base. An exposing hole may be formed in a surface of the cover to expose a portion of the washing ball positioned between the cover and the base. A width of the cover may be gradually decreased from a rear end portion to a front end portion thereof so as to minimize a size of the lift and increase an interior volume of the drum.

19 Claims, 8 Drawing Sheets

DRUM TYPE WASHER

This application claims the benefit of the Korean Patent Application Nos. 10-2005-0057734 and 10-2005-0057735, filed on Jun. 30, 2005, which are hereby incorporated by reference as if fully set forth herein.

BACKGROUND OF THE INVENTION

1. Field of the Invention

The present invention relates to a washer, and more particularly, to a drum type washer. Although the present invention is suitable for a wide scope of applications, it is particularly suitable for a lift having an improved structure.

2. Discussion of the Related Art

Generally, a drum type washer is a device that washes a laundry by rotating a drum by a drive force of a motor while a detergent, water and laundry are put in the drum. The drum type washer is advantageous in causing little damage to the laundry, preventing the laundry from being raveled and bringing washing effects of beating and rubbing.

A drum type washer according to a related art is explained in detail with reference to FIGS. 1 to 3 as follows.

FIG. 1 is a cross-sectional diagram of a drum type washer according to a related art, FIG. 2 is a perspective diagram of a drum of the drum type washer shown in FIG. 1, and FIG. 3 is a perspective diagram of a lift installed on an inner surface of the drum shown in FIG. 2.

Referring to FIG. 1, a drum type washer according to a related art consists of a body 1 having a laundry entrance provided to its front side, a door 2 provided to the body 1 to open/close the laundry entrance, a tub 3 provided within the body to store water therein, a motor assembly 4 installed at the tub 3 to generate a drive force, a washing shaft connected to the motor assembly 4, and a drum 6 connected to the washing shaft 5 to wash a laundry by the drive force transferred from the motor assembly 4.

The tub 3 is supported by a damper (not shown in the drawing) and a spring (not shown in the drawing). The damper and spring play a role in attenuating a vibration generated from the rotations of the motor assembly and drum 4 and 6.

The motor assembly 4 adopts an indirect drive mechanism for rotating the drum 6 by transferring the drive force generated from a motor to the washing shaft 5 via a belt or a direct drive mechanism for rotating the drum 6 by transferring the drive force generated from the motor to the washing shaft 5 directly.

The drum 6 is made of a stainless steel based material. A spider 8 is provided to a closed rear lateral side of the drum 6 to reinforce solidity of the rear lateral side of the drum 6. And, the washing shaft 6 is joined to a rotational center of the spider 8.

The spider 8 is formed by die-casting to prevent the drum 6 from being torn or transformed by the rotation of the washing shaft 5. In particular, a portion of the rear lateral side of the drum 6, where the spider 8 is installed, is inwardly projected to further reinforce the solidity of the drum 6.

Referring to FIG. 2, at least one lift 7 is provided to an inner surface of the drum 6 to be almost parallel with the washing shaft 5.

In this case, the at least one lift 7 is built in the drum 6 to expose one portion of a washing ball 7*a* that will be rotated by coming into contact with a laundry. And, the washing ball 7*a* is formed of a ceramic based material to facilitate its rotation in being embedded in the lift 7.

A bottom part of the lift 7, as shown in FIG. 1 and FIG. 2, is fixed to the drum 6 by at least one locking member 7*b* fitted into an outer circumference of the drum 6.

And, a rear end part of the lift 7 is fixed to the portion of the rear lateral side of the drum 6 at which the spider 8 is installed.

The above-configured drum type washer performs a washing work by executing a series of a washing cycle, a rinsing cycle and a dewatering cycle in sequence.

And, the washing, rinsing or dewatering cycle can be selectively carried out according to a user's selection.

Moreover, it is understandable that a laundry can be washed in various ways according to its type.

Once the drum type washer executes the washing cycle, the drum 6 is rotated at a low speed centering around the washing shaft 5 by the drive force transferred from the motor assembly 4.

In doing so, the laundry is lifted up while the lift 7 rotates to arrive at a prescribed height. The laundry then falls down after arriving at the prescribed height. Thus, the lift 7 repeats a process of lifting the laundry to fall in rotating the drum 6 during a prescribed time. This process enables the laundry to be washed.

Once the drum type washer executes the dewatering cycle, the drum 6 rotates at a high speed centering on the washing shaft 5. In doing so, the laundry accommodated within the drum 6 is dewatered by a centrifugal force.

However, the related art drum type washer has the following problems.

First of all, the lift, as shown in FIG. 1, is fixed to the drum by fitting the locking member in the outer circumference of the drum. So, in case that the washing ball formed of the ceramic based material is broken, the drum needs to be completely dissembled from the tub and the motor assembly to replace the broken washing ball.

So, the drum type washer needs to be sent to a manufacturer or service center for the replacement of the broken washing ball, whereby a transport cost, a repair cost and a repair time increase.

Secondly, the difficulty in replacing a trivial part may reduce user's reliance on a product.

SUMMARY OF THE INVENTION

Accordingly, the present invention is directed to a drum type washer that substantially obviates one or more problems due to limitations and disadvantages of the related art.

An object of the present invention is to provide a drum type washer, by which a replacement of a washing ball provided to a lift is facilitated.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum type washer according to the present invention includes a tub, a drum rotatably provided within the tube, and a lift provided within the drum, the lift including a base part detachably assembled to an inner surface of the drum and a cover part detachably assembled to the base part to enable a replacement of a washing ball, wherein an exposing hole is provided to a surface of the cover part to expose a portion of the washing ball and wherein a width of the cover part is decreased toward a front side of the cover part from a rear side of the cover part.

Preferably, the cover part has an upwardly convex shape to cover an upper side of the base part.

Preferably, a guide piece is provided to either an edge of the base part or a lower edge of the cover part and a guide recess is provided to either the lower edge of the cover part or the edge of the base part to have the guide piece slid to be inserted therein.

More preferably, the base part and the cover part are locked to each other by a locking bolt.

Preferably, a hook is provided to either a lower surface of the base part or an inner circumference of the drum and a recess to have the hook inserted therein is provided to the inner circumference of the drum or the lower surface of the base part.

Preferably, the base part is locked by a locking bolt to be fixed to an inner circumference of the drum.

Preferably, a rear end of the base part is upwardly projected and the rear end of the base part is locked to a rear side of the drum by a locking bolt.

More preferably, a solidity-reinforcing rib is provided to the rear end of the base part.

Preferably, the drum type washer further includes a supporter detachably provided to a lower side of the cover part, the supporter having a support recess rotatably supporting a lower portion of the washing ball.

More preferably, a hook part is provided to both ends of the supporter, a locking part is provided to the lower side of the cover part, and the hook part is fitted into the locking part to be fixed thereto.

More preferably, the locking part includes a pair of extensions extending to oppose each other and a hanging portion projected from at least one of a pair of the extension.

More preferably, the hook part includes a support portion extending from the supporter, a connecting portion extending from the support portion vertically, the connecting portion inserted between a pair of the extensions to be fixed thereto, and an insertion-guide portion extending from the connecting portion vertically to be guided along inner walls of the extensions.

More preferably, an end portion of the hook part is projected to have a '⊏' shape. And, a direction of the end portion of the hook part projected from one end of the supporter is opposite to that from the other end of the supporter.

Preferably, at least one portion of an upper surface of the base is configured to have a same profile of a lower surface of the supporter.

In another aspect of the present invention, a lift in a washer includes a base part fixed to an inner circumference of a drum and a cover part detachably assembled to the base part to enable a replacement of a washing ball, wherein an exposing hole is provided to a surface of the cover part to expose a portion of the washing ball and wherein a width of the cover part is decreased toward a front side of the cover part from a rear side of the cover part.

In a further aspect of the present invention, a lift in a washer includes a base part fixed to an inner circumference of a drum, a cover part detachably assembled to the base part to enable a replacement of a washing ball, wherein an exposing hole is provided to a surface of the cover part to expose a portion of the washing ball and wherein a width of the cover part is decreased toward a front side of the cover part from a rear side of the cover part, and a supporter detachably provided to a lower side of the cover part to support a lower portion of the washing ball rotatably, the supporter having a support recess rotatably supporting a lower portion of the washing ball.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 4:
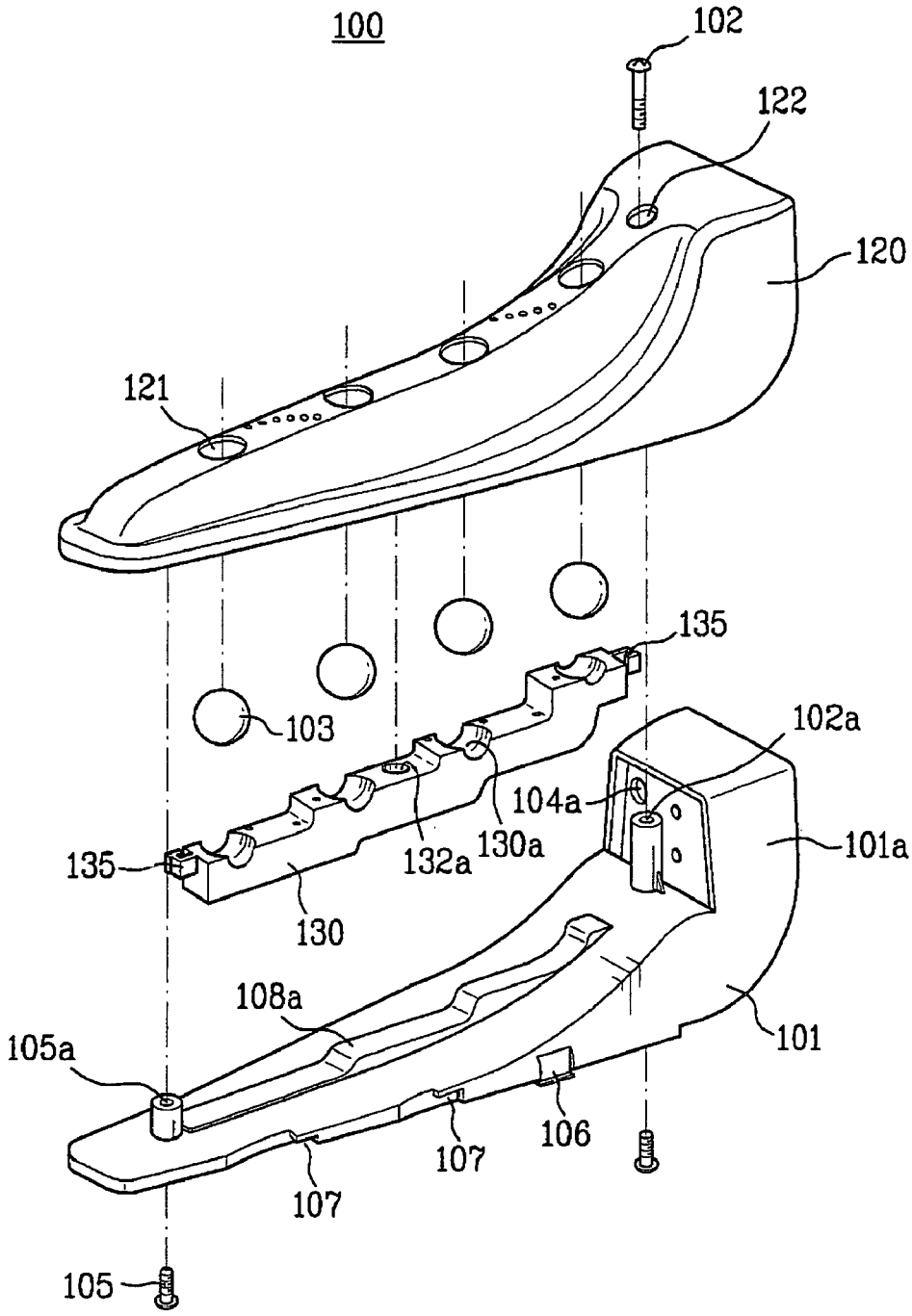
FIG. 4 is an exploded perspective view of a lift according to the present invention.
Figure 5:
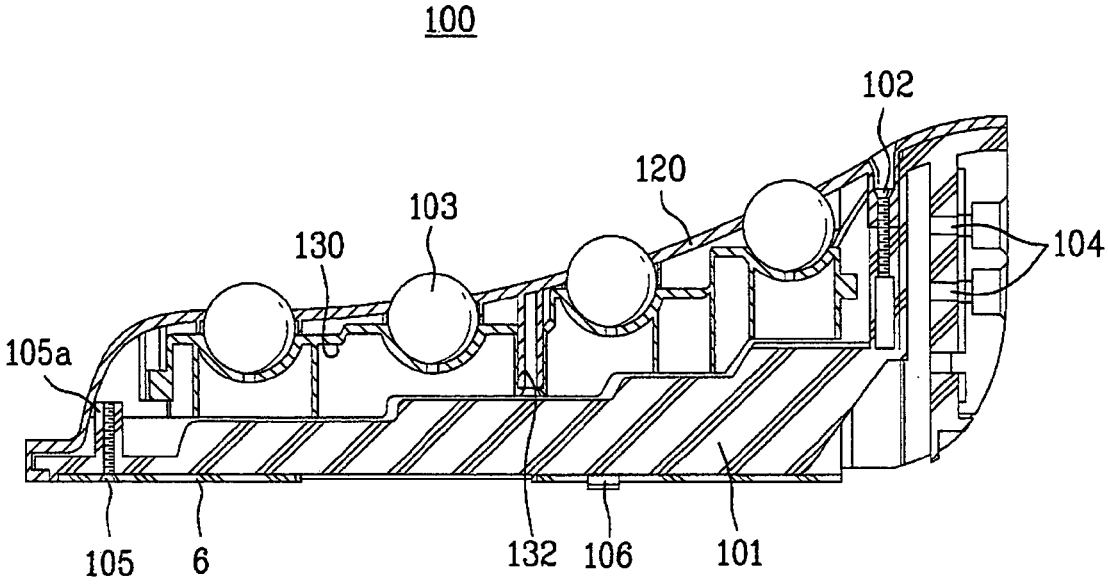
FIG. 5 is a cross-sectional diagram of a fixed structure of a lift according to the present invention.
Figure 6:
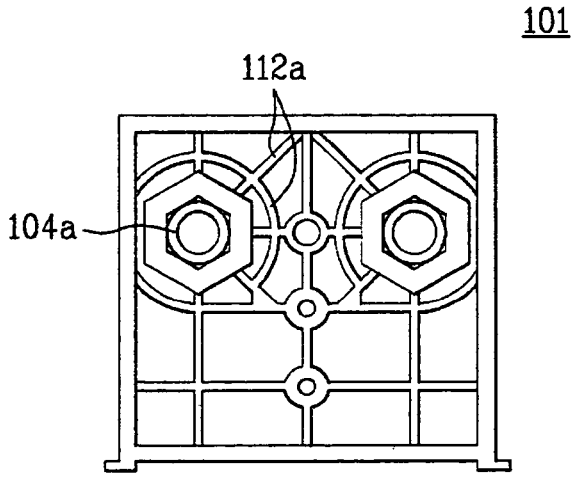
FIG. 6 is a layout of a rear side of a base part of a drum type washer according to the present invention.

FIG. 4 is an exploded perspective view of a lift according to the present invention, FIG. 5 is a cross-sectional diagram of a fixed structure of a lift according to the present invention, and FIG. 6 is a layout of a rear side of a base part of a drum type washer according to the present invention.

Figure 7A:
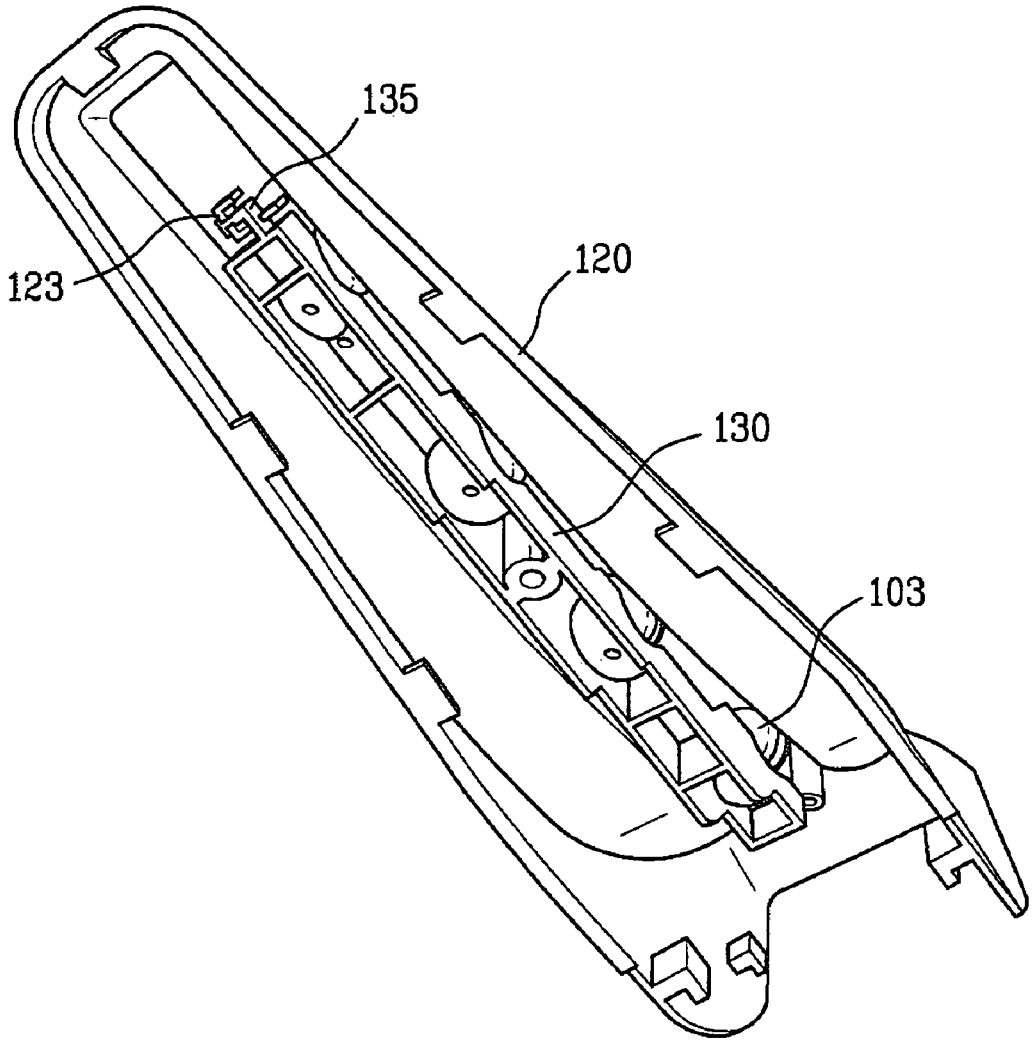
FIG. 7A is a perspective diagram of a rear side of an assembly of a cover part and a supporter according to the present invention.
Figure 7B:
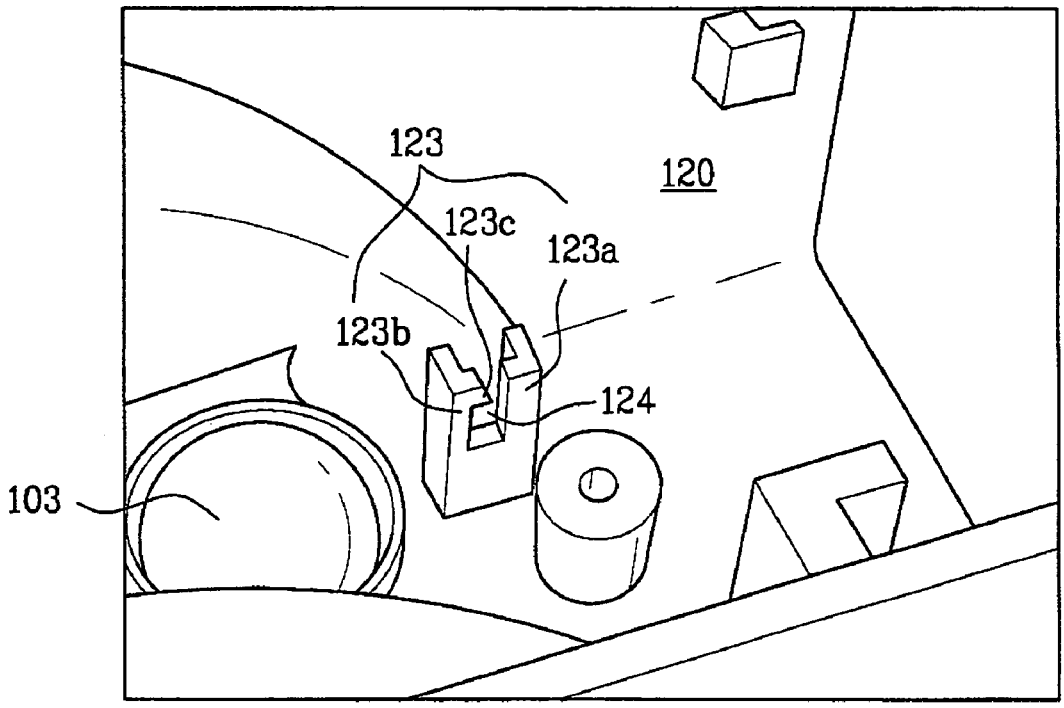
FIG. 7B is a magnified perspective diagram of a fixing part provided to a rear side of a cover part according to the present invention.

FIG. 7A is a perspective diagram of a rear side of an assembly of a cover part and a supporter according to the present invention, and FIG. 7B is a magnified perspective diagram of a fixing part provided to a rear side of a cover part according to the present invention.

Figure 7C:
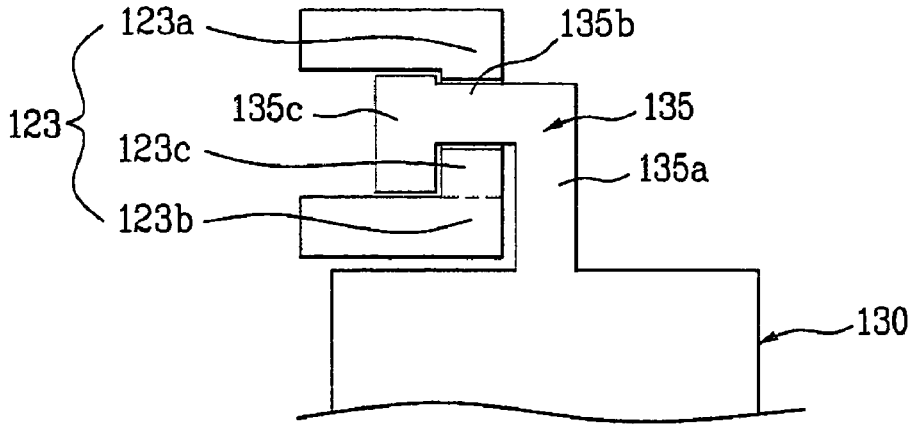
FIG. 7C is a layout of a fixing part and a hook part according to the present invention.
Figure 8:
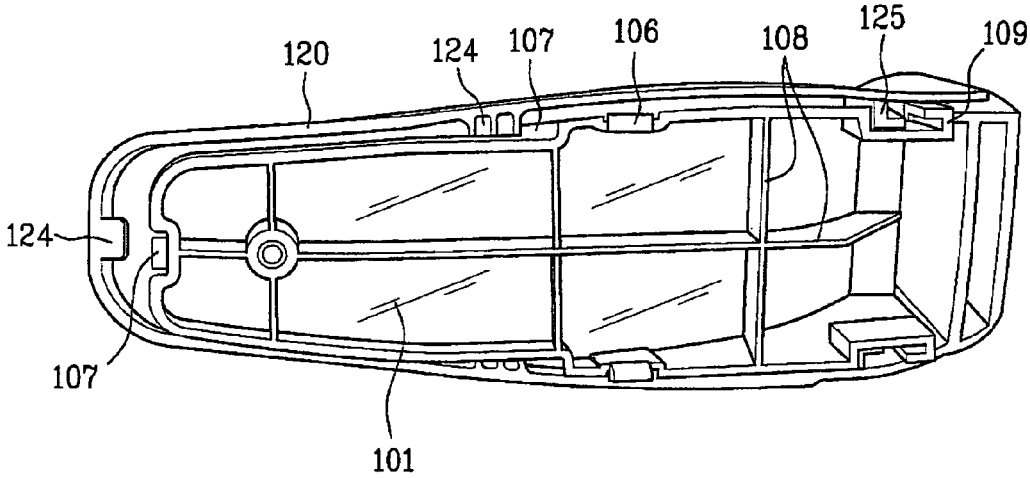
FIG. 8 is a perspective diagram of an assembly of a base part and a cover part according to the present invention.

FIG. 7C is a layout of a fixing part and a hook part according to the present invention, and FIG. 8 is a perspective diagram of an assembly of a base part and a cover part according to the present invention.

Figure 2:
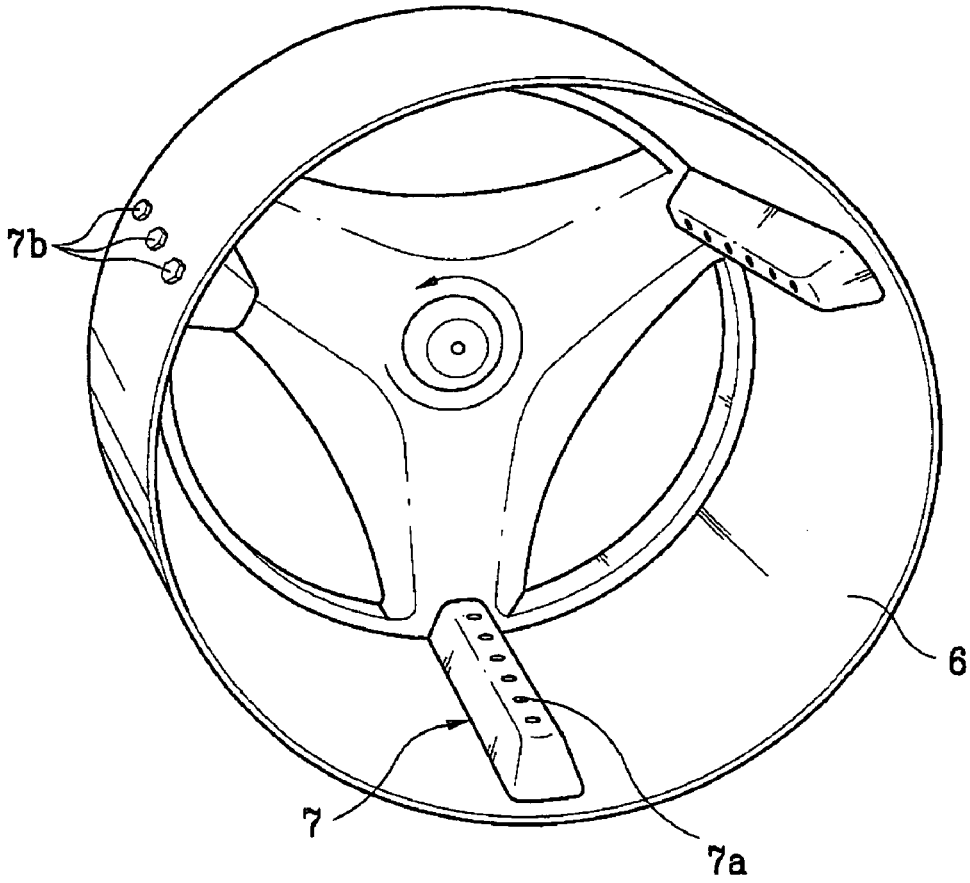
FIG. 2 Prior Art
FIG. 2 is a perspective diagram of a drum of the drum type washer shown in FIG. 1.
Figure 3:
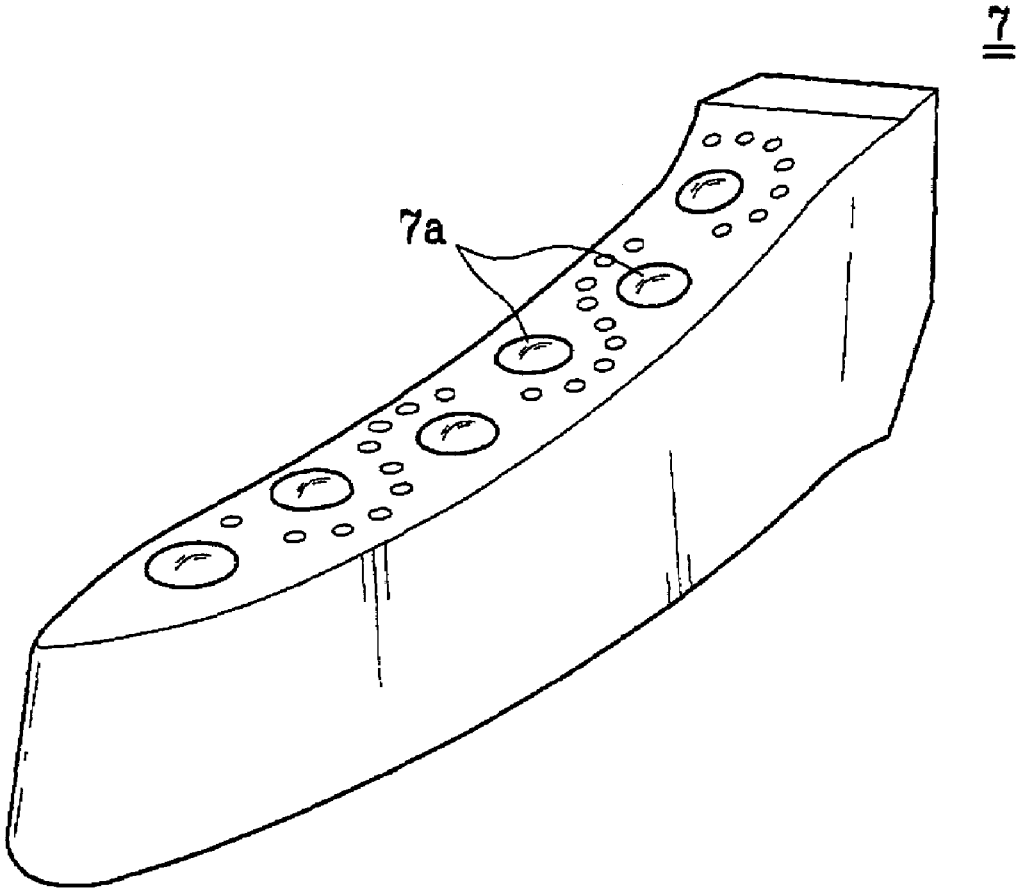
FIG. 3 Prior Art
FIG. 3 is a perspective diagram of a lift installed on an inner surface of the drum shown in FIG. 2.

Referring to FIG. 4, a drum type washer according to the present invention includes a drum (cf. '6' in FIG. 2) and at least one lift 100.

The at least one lift 100 preferably includes a cover part 120, a base part 101 and a supporter 130.

The drum 6 is rotatably provided within a tub. And, the at least one lift 100 is preferably provided to an inner circumference of the drum in a circumferential direction to be projected with an interval of a prescribed angle.

The lift 100 plays a role in lifting up a laundry to fall while the drum is rotating. In order to prevent the laundry from being damaged, at least one washing ball 103 is provided to an upper surface of the lift 100 to be smoothly rotated in case of coming contact with the laundry. In this case, the at least one washing ball 103 is installed to have its portion projected and exposed. Preferably, the at least one washing ball 103 is formed of a ceramic based material to enable its rotation attributed to friction with the laundry.

In order to facilitate a replacement of the washing ball 103 that is broken, it is preferable that the lift 100 can be dissembled. For this, the cover part 120 is detachably assembled to the base part 101. In this case, each of the cover part 120 and the base part 101 is preferably formed long along a length direction of the drum.

In particular, the base part 101 is fixed to the inner circumference of the drum and the cover part 120 is detachably attached to a lower end portion of the base part 101.

A separation-preventing hole 121 is provided to the cover part 120 to enable a portion of the washing ball 103 to be exposed toward an inside of the drum. Preferably, a rim of the separation-preventing hole 121 is rounded to come into contact with the washing ball 103 smoothly.

So, the washing ball 103 projected toward the inside of the drum via the separation-preventing hole 121 is able to prevent the laundry from being damaged in case of a high-speed rotation of the drum, while being rotated in coming into contact with the laundry.

Preferably, the cover part 120 is formed tapered toward its front side from its rear side. This is to increase a volume of the drum. By reducing a width of the cover part 120, the volume of the drum can be increased in proportion to the reduced width without decreasing sizes of the body and drum.

Meanwhile, if the base part is projected convex upwardly, if the cover part is formed narrow along the area having the washing ball formed therein, and if the cover part is assembled to an upper end of the base part, a gap can be generated from the assembled area. So, a problem that the laundry is stuck in the gap may be caused.

To prevent the problem from being caused, the cover part 120 of the present invention is configured convex upwardly in one body to cover the upper portion of the base part 101 completely.

Preferably, the lift 100, as shown in FIG. 4, further includes a supporter 130 supporting a lower portion of the washing ball 103 rotatably.

More preferably, the supporter 130 is provided between the cover part 120 and the base part 101 to be detachable under the cover part 120.

A support recess 130*a* is formed on the supporter 130 to support the lower portion of the washing ball 103 rotatably.

The support recess 130*a* has a hemispherical shape having an almost same diameter of the washing ball 103. So, the washing ball 103 can be rotatably supported between the cover part 120 and the supporter 130.

The supporter 130, as shown in the drawing, can be independently provided to the base part 101 to be assembled thereto. Alternatively, the supporter 130 can be built in one body of the upper portion of the base part 101.

Explained in the following description is a structure that the base part 101 is fixed to the inner circumference of the drum.

FIG. 5 is a cross-sectional diagram of a fixed structure of a lift according to the present invention, and FIG. 6 is a layout of a rear side of a base part of a drum type washer according to the present invention.

Referring to FIGS. 4 to 6, hooks 106 are 106 provided to both sides of a lower portion of the base part 101, respectively. And, recesses are provided to portions of the drum 6 to oppose the hooks 106, respectively. So, the hooks 106 are elastically fitted into the recesses to be locked together, respectively.

Hence, a pre-assembly between the base part 101 and the drum is achieved and a position for a locking of a locking member 105 such as a fixing bolt can be automatically aligned.

Alternatively, the hooks 106 are provided to the drum and the recesses for the hooks 106 can be provided to the lower surface of the base part 101.

A rear portion 101*a* of the base part 101, as shown in the drawings, is projected upward and is fixed to the rear side of the drum by a locking of a fixing member 104 such as a fixing bolt 104.

For this, a locking hole 104*a* is formed at the rear portion 101*a* of the base part 101. The fixing member 104 passes through the rear side of the drum to be locked into the locking hole 104*a*.

Figure 1:
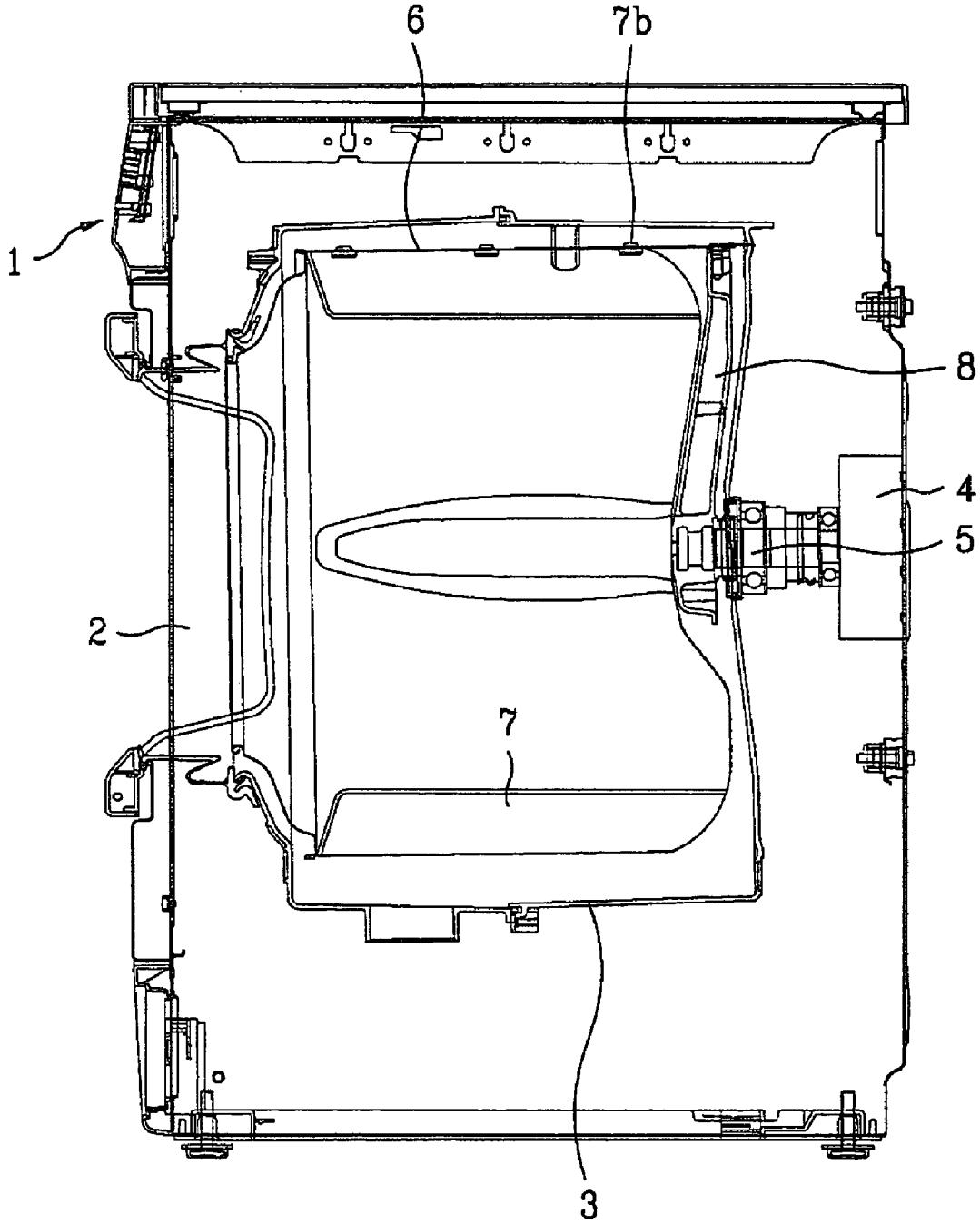
FIG. 1 Prior Art
FIG. 1 is a cross-sectional diagram of a drum type washer according to a related art.

Preferably, the fixing member 104 is locked to the portion where the spider (cf. '8' in FIG. 1 or FIG. 2) joining the drum and a bearing housing together in the rear lateral side of the drum.

Preferably, a locking boss 105*a* is provided to a front portion of the base part 101 to be externally locked with the locking member 105 such as a bolt.

Hence, if the fixing member 105 is locked into the locking boss 105*a* to enable the front and rear portions of the base part 101 to be stably fixed to the inner circumference of the drum.

Referring to FIG. 6, for the reinforcement of a rear support structure of the lift to which the fixing member 104 is locked, a solidity reinforcing rib 112*a* is preferably provided to the rear side of the base part 101 by injection molding.

Hence, even if an intensive stress is structurally concentrated on the locking hole 104*a*, it is able to prevent the locking hole 104*a* from being damaged.

FIG. 7A is a perspective diagram of a rear side of an assembly of a cover part and a supporter according to the present invention, FIG. 7B is a magnified perspective diagram of a fixing part provided to a rear side of a cover part according to the present invention, and FIG. 7C is a layout of a fixing part and a hook part according to the present invention.

Referring to FIG. 7A, a pair of hook parts 135 are provided to both ends of the supporter 130, respectively. And, a pair of locking parts 123 are provided to a lower surface of the cover part 120. So, the hook parts 135 are fitted into the locking parts 123 to be fixed thereto, respectively.

Referring to FIG. 7B, each of the locking parts 123 includes a first extension 123*a* and a second extension 123*b* opposing each other. And, the corresponding hook part 135 is fitted into the locking hole 124 between the first and second extensions 123*a* and 123*b*.

A hanging portion 123*c* is provided to either the first extension 123*a* or the second extension 123*b* to catch the fitted hook part 135.

So, if the hook part 135 is pushed between the first and second extensions 123*a* and 123*b*, the hanging portion 123*c* is elastically retreated to enable the hook part 135 to be inserted between the first and second extensions 123*a* and 123*b* to be locked therein.

Alternatively, the hook parts 135 are provided to one side of the base part 101 and the locking parts 123 are provided to the lower surface of the cover part 120.

Referring to FIG. 7C, each of the hook parts 135 includes a support portion 135*a*, a connecting portion 135*b* and an insertion guide portion 135*c*.

The support portion 135*a* extends from the supporter 130 and the connecting portion 135*b* extends in a direction vertical to the support portion 135*a*.

So, the connecting portion 135*b* is inserted between a pair of the extensions 123*a* and 123*b* and is then postured in the locking hole 124 to be fixed thereto.

The insertion guide portion 135*c* vertically extends from the connecting portion 135*b* to be guided along inner walls of the extension portions 123*a* and 123*b*.

Preferably, the insertion guide portion 135*c* extends in both directions vertical to an end portion of the connection portion 135*b* to a prescribed length. Alternatively, the insertion guide portion 135*c* is able to extend in one direction only.

If the fixed supporter 130 is pulled by a prescribed external force, the hook part 135 can be detached from the locking part 123. So, the hook part 135 can be separated from the fixing part 123. Through this, the supporter 130 can be detached from the cover part 120 with ease.

For a more stable fixing structure, as shown in FIG. 4 and FIG. 5, a locking boss 102*a* can be provided to the base part 101 and a locking member 102 such as a bolt can extend through a locking hole 122 in the cover part 120 and be locked into the locking boss 102*a* to fix the cover part 120 and the supporter 130 to the base part 101 from the upper side of the cover part 120.

Through this, both ends of the supporter 130 can be fixed to the lower surface of the cover part 120.

Once the cover part 120 is assembled to the upper side of the base part 101, the lower surface of the supporter 130 can be stably supported by the upper surface of the base part 101. For this, it is preferable that the lower surface of the supporter 130 has the same profile of at least one portion of the upper surface of the base part 101. And, it is a matter of course that a profile portion 108*a*, as shown in the drawing, having the same profile of the lower surface of the supporter 130 can be projected or recessed from the upper surface of the base part 101.

FIG. 8 is a perspective diagram of an assembly of a base part and a cover part according to the present invention.

Referring to FIG. 8, at least one guide piece 124 is provided to a lower edge of the cover part 120 and at least one guide recess 107 is provided to an edge of the base part 101. So, the guide piece 124 is inserted in the guide recess 107 to be locked therein.

In particular, the cover part 120 postured on a prescribed position of the upper surface of the base part 101 is slid, the guide piece 124 is fitted into the guide recess 107 to prevent the base part 101 from being separated from the cover part 120.

Alternatively, the guide piece is provided to the edge of the base part 101 and the guide recess 107 is provided to the lower edge of the cover part 120.

Preferably, a first locking piece 109 and a second locking piece 125 are provided to rear side edges of the base part 101 and the cover part 120 to be locked together by having '⌉' shapes, respectively. By the first and second locking pieces 109 and 125, the lower edge of the cover part 120 and the edge of the base part 101 are locked together.

Preferably, a rib 108 for solidity reinforcement is projected from the lower surface of the base part 101.

A process for assembling the above-configured lift according to the present invention is explained as follows.

First of all, the base part 101 is fixed to the inner circumference of the drum.

In particular, the hook 106 provided to the base part 101 is pre-assembled to the recess provided to the drum. In doing so, since locking positions of the locking members 104 and 105 are automatically aligned, the locking members 104 and 105 are locked into the aligned positions to enable the base part 101 to be stably fixed to the inner circumference of the drum.

Preferably, the step of fixing the base part 101 to the drum is carried out before the drum is installed within the tub.

Subsequently, the washing ball 103 is inserted in the support recess 130*a* of the supporter 130. The supporter 130 is then assembled to the lower surface of the cover part 120. For this, the hook parts 135 provided to both of the ends of the supporter 130 are fitted into the locking parts 123 provided to the lower surface of the cover part 120, respectively. So, the supporter 130 is detachably assembled to the lower surface of the cover part 120.

The cover part 120 having the supporter 130 assembled thereto is slid on the base part 101 to be detachable assembled thereto.

In particular, the guide piece 124 provided to the lower edge of the cover part 120 is slid into the guide recess 107 provided to the edge of the base part 101, thereby completing the pre-assembly. The locking member 102 is then locked from the upper side of the cover part 120, thereby completing the locking between the cover part 120 and the base part 101.

Meanwhile, if the washing ball is broken in operating the drum type washer, the cover part and the supporter are disassembled to facilitate the replacement of the broken washing ball.

Accordingly, the present invention provides the following effects or advantages.

First of all, since the lift is detachably provided within the drum, it is able to replace the washing ball of the lift and the like without dissembling the drum, the tub, the motor assembly and the like. In particular, since the supporter is detachably fixed to the cover part by the hook locking mechanism, it is able to separate the supporter from the cover part with ease. Hence, the repair time and cost of the washer can be considerably reduced.

Secondly, since the hook parts projected in opposite directions from both ends of the supporter are joined to the locking part, it is able to effectively prevent the supporter from rocking back and forth or right to left.

Thirdly, since the cover part in one body is projected to cover the whole upper portion of the base part, it is able to prevent the laundry from being stuck in the assembled part of the lift.

Fourthly, unlike the related art lift, the lift of the present invention has the width tapered toward its front side, thereby increasing the volume of the drum.

Finally, the lift of the washer according to the present invention is applicable to a dryer.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum type washer, comprising:

a tub;

a drum rotatably installed in the tub; and a lift provided within the drum, the lift comprising:

a base part detachably coupled to an inner surface of the drum; and a cover part detachably coupled to the base part, wherein the cover part comprises:

a separation preventing hole that extends through a top side of the cover part so as to expose an upper portion of a washing ball that is positioned between the cover part and the base part; and a locking hole that extends through the top side of the cover part, wherein the fastening locking hole receives a locking member that couples the cover part to the base; and a supporter provided between the cover part and the base part, and detachably coupled to a bottom surface of the top side of the cover part, wherein the supporter includes a support recess that rotatably supports a lower portion of the washing ball and allows the user portion of the washing ball to extend through the separation preventing hole.

2. The drum type washer of claim 1, wherein the cover part has an upwardly extending convex shape so as to completely cover an upper side of the base part.

3. The drum type washer of claim 1, further comprising a guide piece that extends along one of a bottom edge of the base part or a bottom edge of the cover part, and a guide recess that extends along the other of the bottom edge of the cover part or the bottom edge of the base part, wherein the guide piece is slidably received in the guide recess so as to slidably couple the cover part and the base part.

4. The drum type washer of claim 3, wherein the locking member comprises a locking bolt that extends through the locking hole in the cover part and into a locking boss provided on a top surface of the base part.

5. The drum type washer of claim 1, further comprising a hook provided at one of a bottom surface of the base part or an inner circumferential surface of the drum, and a recess that receives the hook inserted therein provided at the other of the bottom surface of the base part or the inner circumferential surface of the drum.

6. The drum type washer of claim 5, wherein the hook slides relative to the recess in a direction substantially parallel to an axis of rotation of the drum.

7. The drum type washer of claim 1, further comprising least one locking bolt that extends through a locking boss formed in the base part and into an inner circumferential surface of the drum so as to fix the base part to the drum.

8. The drum type washer of claim 1, wherein a rear end of the base part projects upwardly, and wherein the rear end of the base part is locked to a rear wall of the drum by a locking bolt.

9. The drum type washer of claim 8, further comprising a reinforcing rib provided with the rear end of the base part, on a side thereof that is positioned adjacent to the rear wall of the drum.

10. The drum type washer of claim 1, further comprising a hook part provided at each of two opposite ends of the supporter, and a locking part provided at each of two opposite end portions of the lower surface of the top side of the cover part, at positions corresponding to the hook parts, wherein the hook part is fitted into the locking part so as to fix the supporter to the cover part.

11. The drum type washer of claim 10, wherein each of the locking parts comprises:

a pair of extensions that each extend down from the lower surface of the top side of the cover part so as to oppose each other; and a hanging portion that projects from one of the pair of extensions toward the other of the pair of extensions.

12. The drum type washer of claim 11, wherein each of the hook parts comprises:

a support portion that extends outward from a respective end of the supporter;

a connecting portion that extends from an end of the support portion perpendicular thereto, wherein the connecting portion is inserted between the pair of extensions of the respective locking part; and a guide portion that extends from an end of the connecting portion, perpendicular thereto, so as to be guided along inner walls of the pair of extensions.

13. The drum type washer of claim 10, wherein an end portion of the hook part has a '⊏' shape.

14. The drum type washer of claim 13, wherein a direction of the end portion of the hook part projected from one end of the supporter is opposite to the hook part projected from the other end of the supporter.

15. The drum type washer of claim 1, wherein at least a portion of the upper side of the base part is configured to have a same profile as a lower surface of the supporter.

16. The chum type washer of claim 1, wherein a width of the cover part gradually decreases from a rear end to a front end thereof.

17. A lift for a washer, the lift comprising:

a base part configured to be fixed to an inner circumferential surface of a drum;

a cover part detachably coupled to the base, wherein the cover part comprises:

a separation preventing hole that extends through a top side of the cover part so as to expose a portion of a washing ball positioned between the cover part and the base part; and a locking hole that extends through the top side of the cover part so as to receive a locking member that couples the cover part to the base part; and a supporter provided between the cover part and the base part. and detachably coupled to a bottom surface of the top side of the cover part, wherein the supporter includes a support recess that rotatably supports a lower portion of the washing ball and allows the user portion of the washing ball to extend through the separation prevention hole.

18. A lift for a washer, the lift comprising:

a base part configured to be fixed to an inner circumferential surface of a drum;

a cover part detachably coupled to the base part, wherein the cover part comprises:

separation preventing hole that extends through a top side of the cover part so as to expose a portion of a washing ball positioned between the base part and the cover part; and a locking hole that extends through the top side of the cover part so as to receive a locking member that couples the cover part to the base part; and a supporter provided between the cover part and the base part, and detachably coupled to a lower surface of the top side of the cover part, wherein the supporter includes a support recess that rotatably supports a lower portion of the washing ball.

19. The lift of claim 18, wherein a width of the cover part gradually decreases from a rear end to a front end thereof.

* * * * *